US012123407B2

(12) United States Patent
Alulkar et al.

(10) Patent No.: US 12,123,407 B2
(45) Date of Patent: Oct. 22, 2024

(54) COMPRESSED AIR GENERATION PLANT

(71) Applicant: ATLAS COPCO (INDIA) LTD., Pune (IN)

(72) Inventors: Amol Suresh Alulkar, Pune (IN); Satyavan Bhanudas Ghule, Pune (IN); Vikram Vikram Gulliani, Pune (IN); Swapnil Satyawan Awate, Pune (IN); Saurabh Achyut Kulkarni, Pune (IN)

(73) Assignee: ATLAS COPCO (INDIA) LTD., Pune (IN)

( * ) Notice: Subject to any disclaimer, the term of this patent is extended or adjusted under 35 U.S.C. 154(b) by 24 days.

(21) Appl. No.: 17/713,272

(22) Filed: Apr. 5, 2022

(65) Prior Publication Data

US 2022/0341412 A1 Oct. 27, 2022

(30) Foreign Application Priority Data

Apr. 24, 2021 (IN) ..... 202121018988

(51) Int. Cl.
*F04B 39/06* (2006.01)
*F04B 25/00* (2006.01)
*F28D 9/00* (2006.01)

(52) U.S. Cl.
CPC ..... *F04B 39/06* (2013.01); *F04B 25/00* (2013.01); *F28D 9/0093* (2013.01); *F28F 2250/08* (2013.01)

(58) Field of Classification Search
CPC ..... F04B 25/00; F04B 39/06; F04B 41/06; F04D 25/08; F04D 29/388; F05D 2240/307; F28D 9/0093; F28F 2250/08
See application file for complete search history.

(56) References Cited

U.S. PATENT DOCUMENTS 1,473,314 A * 11/1923 Poccia ..... F04B 41/04 417/237
2,738,659 A * 3/1956 Heed ..... F04B 25/02 62/401
3,096,927 A * 7/1963 Wahl ..... F04B 49/24 417/253
3,216,648 A * 11/1965 Ford ..... F04B 25/00 62/93
3,462,074 A * 8/1969 Grimmer ..... F04B 39/102 417/539
4,022,550 A * 5/1977 Brink ..... F04B 39/0033 417/313
4,097,202 A * 6/1978 Price ..... F04B 25/02 417/454

(Continued)

*Primary Examiner* — Charles G Freay
*Assistant Examiner* — Benjamin Doyle
(74) *Attorney, Agent, or Firm* — BACON & THOMAS, PLLC

(57) ABSTRACT

The present disclosure relates to and envisages a compressed air generation system. The compressed air generation system includes a multistage reciprocating compressor for providing compressed air at a high pressure. A combi-cooler assembly includes a pair of intercoolers and a radiator assembly is configured to dissipate heat recovered by the cooling fluid from first reciprocating compression stage, second reciprocating compression stage, third reciprocating compression stage and crankcase assembly of the radiator circuit. The system is a stand-alone unit.

13 Claims, 8 Drawing Sheets

(56) References Cited

U.S. PATENT DOCUMENTS 4,830,580 A * 5/1989 Hata ..... F04B 27/00 417/243
5,106,270 A * 4/1992 Goettel ..... F04B 39/066 417/372
5,203,680 A * 4/1993 Waldrop ..... F04B 41/04 417/364
5,386,873 A * 2/1995 Harden, III ..... F04D 29/5833 165/47
5,947,711 A * 9/1999 Myers ..... F01C 21/007 418/101
6,203,285 B1 * 3/2001 Wagner ..... F04B 25/00 417/53
6,447,264 B1 * 9/2002 Lucas ..... F04B 39/0038 417/313
6,629,825 B2 * 10/2003 Stickland ..... F04B 35/04 417/423.15
6,679,689 B2 * 1/2004 Takahashi ..... F04C 29/04 418/83
6,692,235 B2 * 2/2004 Kolodziej ..... F04D 29/5826 417/313
8,534,039 B1 * 9/2013 Pierson ..... F01K 25/106 60/39.182
8,616,856 B2 * 12/2013 Matsuzaka ..... F04B 39/06 417/292
9,897,082 B2 * 2/2018 Worden ..... F04B 27/24
9,951,763 B2 * 4/2018 Hritz ..... F04B 25/005
10,760,490 B2 * 9/2020 Kraft ..... F04D 29/5826
10,907,636 B2 * 2/2021 Sadakata ..... F04C 29/04
2003/0215339 A1 11/2003 Grimmer et al.
2007/0044938 A1 * 3/2007 Farley ..... B60K 11/02 165/41
2009/0297368 A1 * 12/2009 Knox ..... F28D 7/08 29/890.035
2010/0303658 A1 * 12/2010 Ito ..... F04B 39/064 418/9
2011/0200455 A1 * 8/2011 Jordan ..... B60T 13/268 417/251
2012/0100015 A1 * 4/2012 Kim ..... F04D 29/5826 417/244
2012/0180477 A1 * 7/2012 Marsh ..... F02B 29/0425 60/605.2
2012/0227389 A1 * 9/2012 Hinderks ..... F02B 75/002 60/317
2013/0031934 A1 * 2/2013 Huff ..... F28D 7/10 62/510
2013/0263829 A1 * 10/2013 Demots ..... F28F 1/126 165/181
2015/0086392 A1 * 3/2015 Thomes ..... F04B 39/06 417/228
2015/0110647 A1 * 4/2015 Wilhelm ..... F04B 39/0005 417/228
2015/0285264 A1 * 10/2015 Kennedy ..... B61C 5/02 105/62.2
2018/0145381 A1 * 5/2018 Dinh ..... H05K 7/20881
2018/0154302 A1 6/2018 Vertriest et al.
2018/0223876 A1 * 8/2018 Martin ..... F04F 5/46
2018/0291904 A1 * 10/2018 Klaus ..... F04C 29/047
2021/0003127 A1 * 1/2021 Merheim ..... F04B 49/06

* cited by examiner

COMPRESSED AIR GENERATION PLANT

FIELD OF THE INVENTION

The present disclosure relates to a compressed air generation system.

BACKGROUND OF THE INVENTION

The background information herein below relates to the present disclosure but is not necessarily prior art.

For applications requiring very high-pressure compressed air at ambient temperature, a multi-stage compressor with one or more stages of intercooling is required. Typically, a multi-stage reciprocating compressor is incorporated for achieving high pressure ratios, which also generates high temperatures after compression. Water cooling of multi-stage reciprocating compressed air is to achieve desired cooling effect of the compressed air is well known, which require a separate plant for the cooling. Water cooling of compressed air require more space to build the heat-exchanger plant and complicated piping and valve arrangements to control the flow of water to the heat-exchanger plant. Hence more space required. The pressure ratio per stage is usually in the range 3-4 bar, and the adiabatically cooled air gets heated to high temperatures. Hence, an intercooler is placed immediately after the compression stage.

While single-stage or two-stage compression plants are widely known, a plant with three stages compression with two stages of intercooling, providing an overall compression ratio of 1:40-1:50, is rarely realized as a single standalone unit. The unique challenges associated with such a standalone unit include the high magnitude of heat to be removed from the unit in an efficient manner, generation of noise within specified limits, providing ease of installation by minimizing the requirement for cooling ducts, and so on.

Thus, compressed air generation system having multi-stage compression is required, which meets the aforementioned requirements.

Some of the objects of the present disclosure, which at least one embodiment herein satisfies, are as follows.

An object of the present disclosure is to ameliorate one or more problems of the prior art or to at least provide a useful alternative.

Another object of the present disclosure is to provide a compressed air generation system having multi-stage compression.

Yet another object of the present disclosure is to provide a compressed air generation system having multi-stage compression that is a standalone unit.

Still another object of the present disclosure is to provide a compressed air generation system having multi-stage compression from which the high magnitude of heat generated is removed in an efficient manner.

Yet another object of the present disclosure is to provide a compressed air generation system having multi-stage compression that generates noise within the stipulated limits.

Another object of the present disclosure is to provide a compressed air generation system having multi-stage compression that provides ease of installation by minimizing the requirement for cooling ducts.

Other objects and advantages of the present disclosure will be more apparent from the following description, which is not intended to limit the scope of the present disclosure.

SUMMARY OF THE INVENTION

The present disclosure envisages a compressed air generation system. The compressed air generation system comprises a multi-stage reciprocating compressor including a first reciprocating compression stage, a second reciprocating compression stage, and a third reciprocating compression stage. The first reciprocating compression stage is configured to receive air at ambient pressure conditions. The first reciprocating compression stage is configured to compress air to a first predetermined pressure value. The second reciprocating compression stage is in fluid communication with the first reciprocating compression stage. The second reciprocating compression stage is configured to receive compressed air from the first reciprocating compression stage, and is further configured to further compress air to a second predetermined pressure value. The third reciprocating compression stage is in fluid communication with the second reciprocating compression stage. The third reciprocating compression stage is configured to receive compressed air from the second reciprocating compression stage, and further configured to further compress air to a third predetermined pressure value. The compressed air generation system further includes a combi-cooler assembly having at least two intercoolers fluidly communicating with the compressor to receive hot compressed air from the first compressor and the second compressor. The intercoolers are configured to dissipate heat of the compressed air by passing the hot compressed air therethrough to generate relatively cooler compressed air.

BRIEF DESCRIPTION OF THE DRAWINGS

A compressed air generation system having multistage compression. Present disclosure will now be described with the help of the accompanying drawing, in which.

Figure 1:
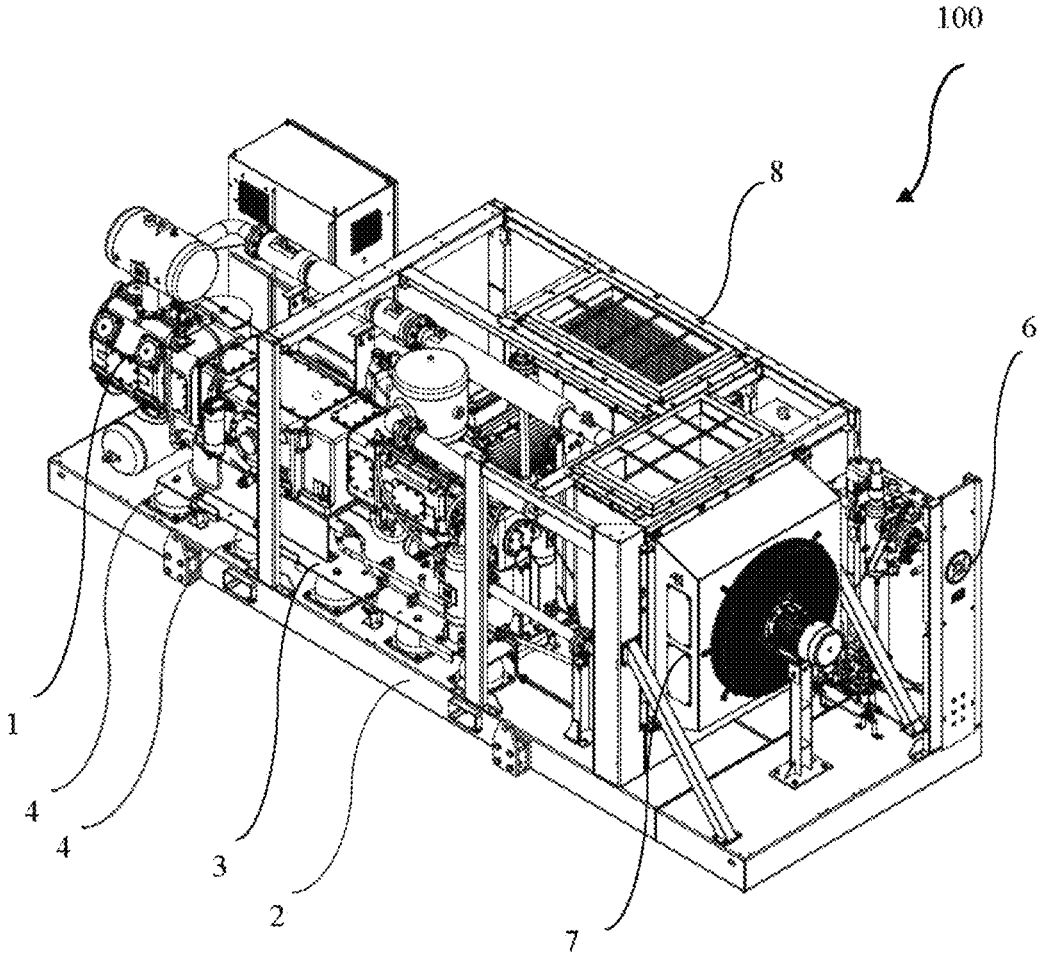
FIG. 1 is an isometric view of the compressed air generation system, in accordance with an embodiment of the present disclosure.

| LIST OF REFERENCE NUMERALS | |
|---|---|
| 1 | multi-stage reciprocating compressor |
| 2 | primary mounting platform |
| 3 | secondary mounting platform |
| 4 | anti-vibration mounts |
| 5 | compressor suction filter |
| 6 | compressor outlet |
| 7 | combi-cooler assembly |
| 7a | combi-cooler casing |
| 7b | combi-cooler air exit duct |

-continued

| LIST OF REFERENCE NUMERALS | |
|---|---|
| 8 | after-cooler assembly |
| 10 | pump |
| 12 | control panel |
| 13 | fan |
| 13a | fan blade |
| 13b | fan blade tip |
| 14 | louvres |
| 100 | compressed air generation system |
| 102a | first reciprocating compression stage |
| 102b | second reciprocating compression stage |
| 102c | third reciprocating compression stage |
| 104a | first intercooler |
| 104b | second intercooler |
| 105 | radiator |
| 105a | inlet of radiator |
| 105b | outlet of radiator |
| 106 | first drive motor |
| 107a | second drive motor |
| 107b | third drive motor |
| 110 | after-cooler heat exchanger |
| 103a, 103b, 103c, | buffer vessel |
| 108a | inlet of intercoooler |
| 108b | outlet of intercooler |
| 109 | frame |
| 111a, 111b, 111c | condensate recovery unit |
| 112 | condensate drain |
| 113 | fastener |
| 114 | fan guard |
| 115 | surge tank |
| 118a | blower fan |
| 118b | after-cooler fan |
| 119 | pressure regulator |
| 120 | solenoid valve |
| 121, 121a | electronic control panel |
| 130 | crank case |
| 200 | air distribution circuit |
| 300 | radiator circuit |
| 126 | vent |
| 127 | Muffler |

DETAILED DESCRIPTION OF THE INVENTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an" and "the" may be intended to include the plural forms as well, unless the context clearly suggests otherwise. The terms "comprises", "comprising", "including" and "having," are open-ended transitional phrases and therefore specify the presence of stated features, elements, modules, units and/or components, but do not forbid the presence or addition of one or more other features, elements, components, and/or groups thereof.

If used herein, the term "and/or" would include any and all combinations of one or more of the associated listed elements.

FIG. 1 is an isometric view of the compressed air generation system 100, in accordance with an embodiment of the present disclosure. Multi-stage reciprocating compressor 1, primary mounting platform 2, secondary mounting platform 3, anti-vibration mount 4, compressor outlet 6, combi-cooler assembly 7 and after-cooler assembly 8 are indicated in FIG. 1.

Figure 2:
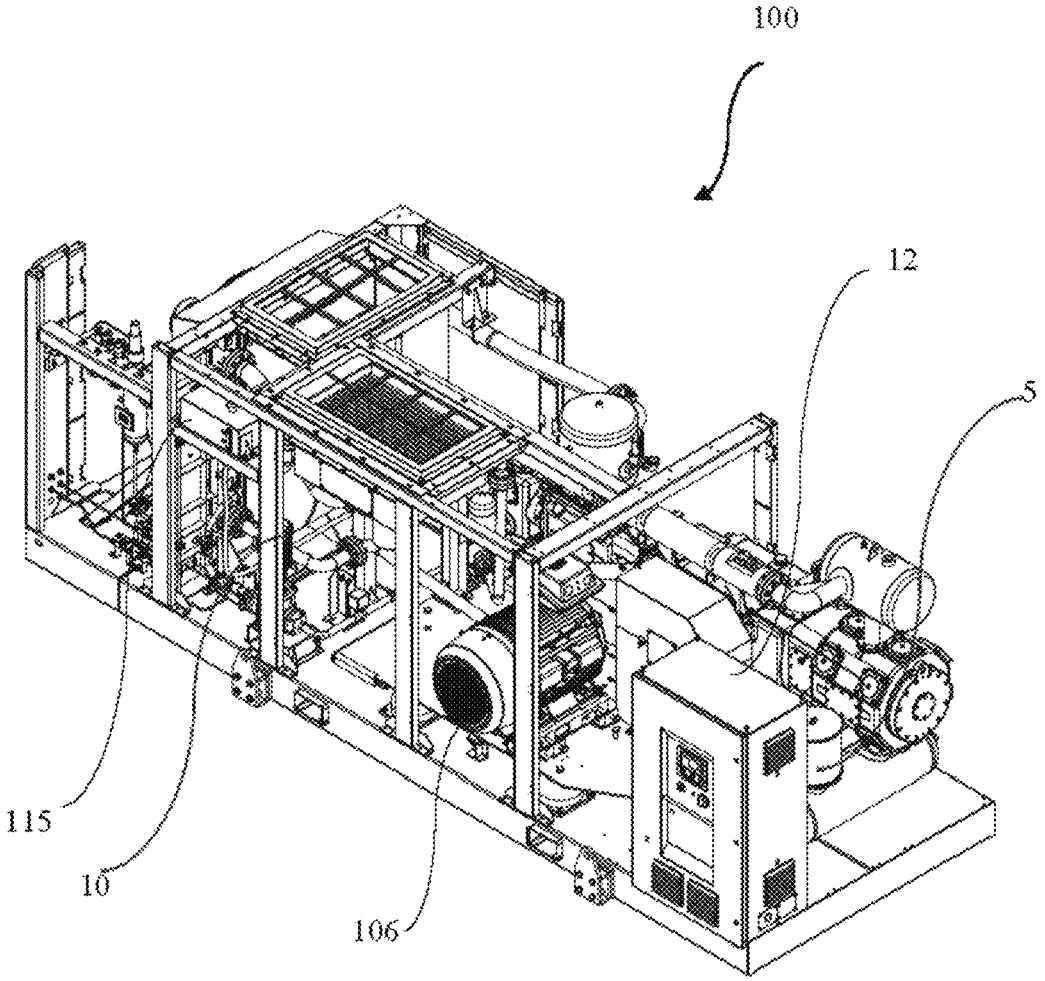
FIG. 2 is another isometric view of the compressed air generation system of FIG. 1.

FIG. 2 is another isometric view of the compressed air generation system 100 of FIG. 1. Compressor suction filter 5, first drive motor 106, pump 10, surge tank 115 and control panel 12 are indicated in FIG. 2.

Figure 3:
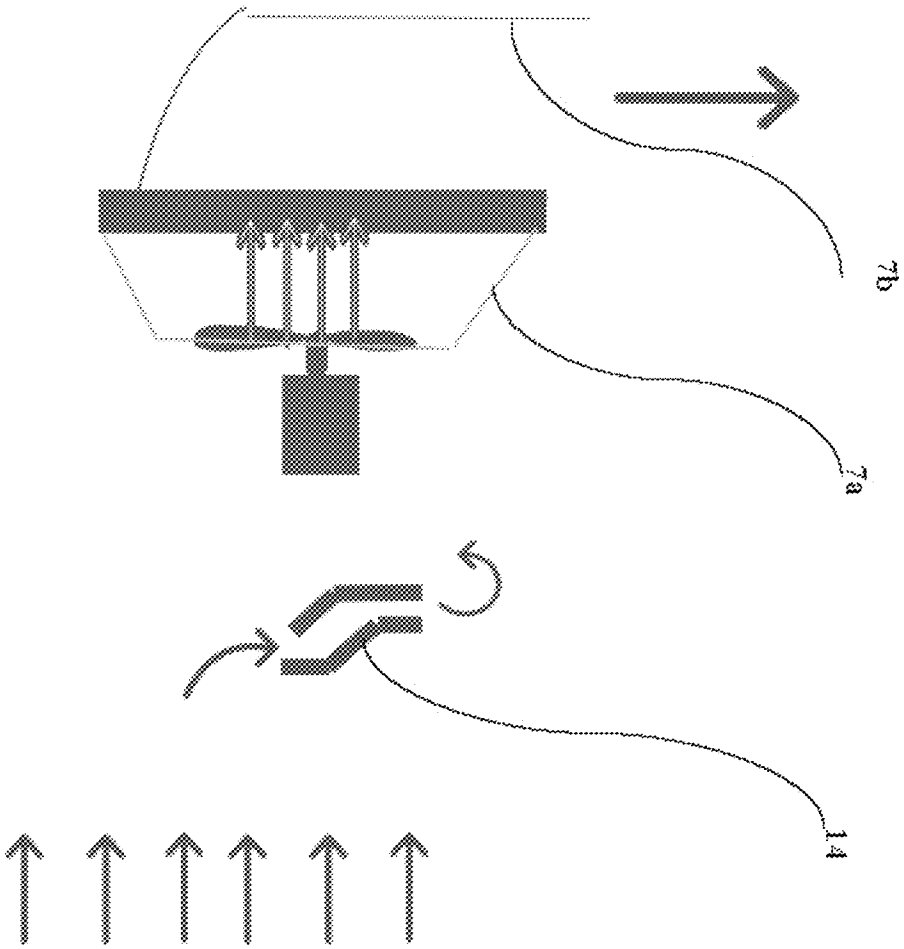
FIG. 3 is a schematic view of the combi-cooler assembly of the present disclosure.

FIG. 3 is a schematic view of the combi-cooler assembly 7 of the present disclosure, wherein the combi-cooler casing 7*a* encloses the first intercooler 104*a*, the second intercooler 104*b* and the radiator assembly 105. Louvres 14 positioned at the air intake of the combi-cooler assembly 7 are also visible in FIG. 2.

Figure 4A:
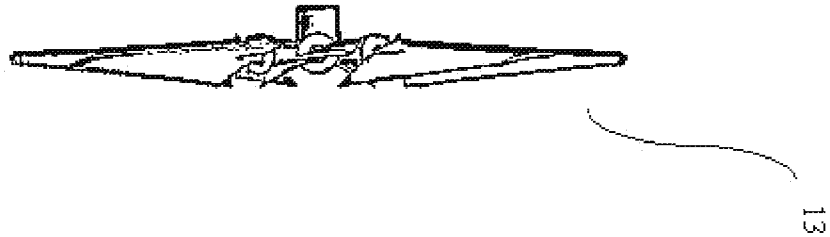
FIG. 4A is a side view of a blower fan used in the system of FIG. 1.
Figure 4B:
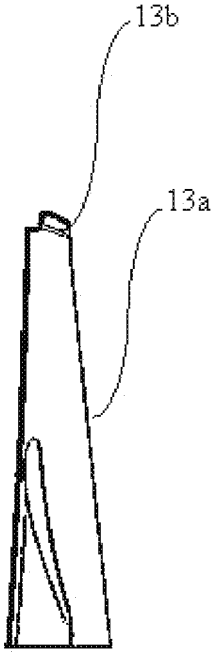
FIG. 4B is a close-up view showing the tip profile of the fan of FIG. 4A.

FIG. 4A is a side view of a fan used in the system of FIG. 1. FIG. 4B is a close-up view showing the tip profile of the fan of FIG. 4A, wherein the Blex tip profile is visible.

Figure 5:
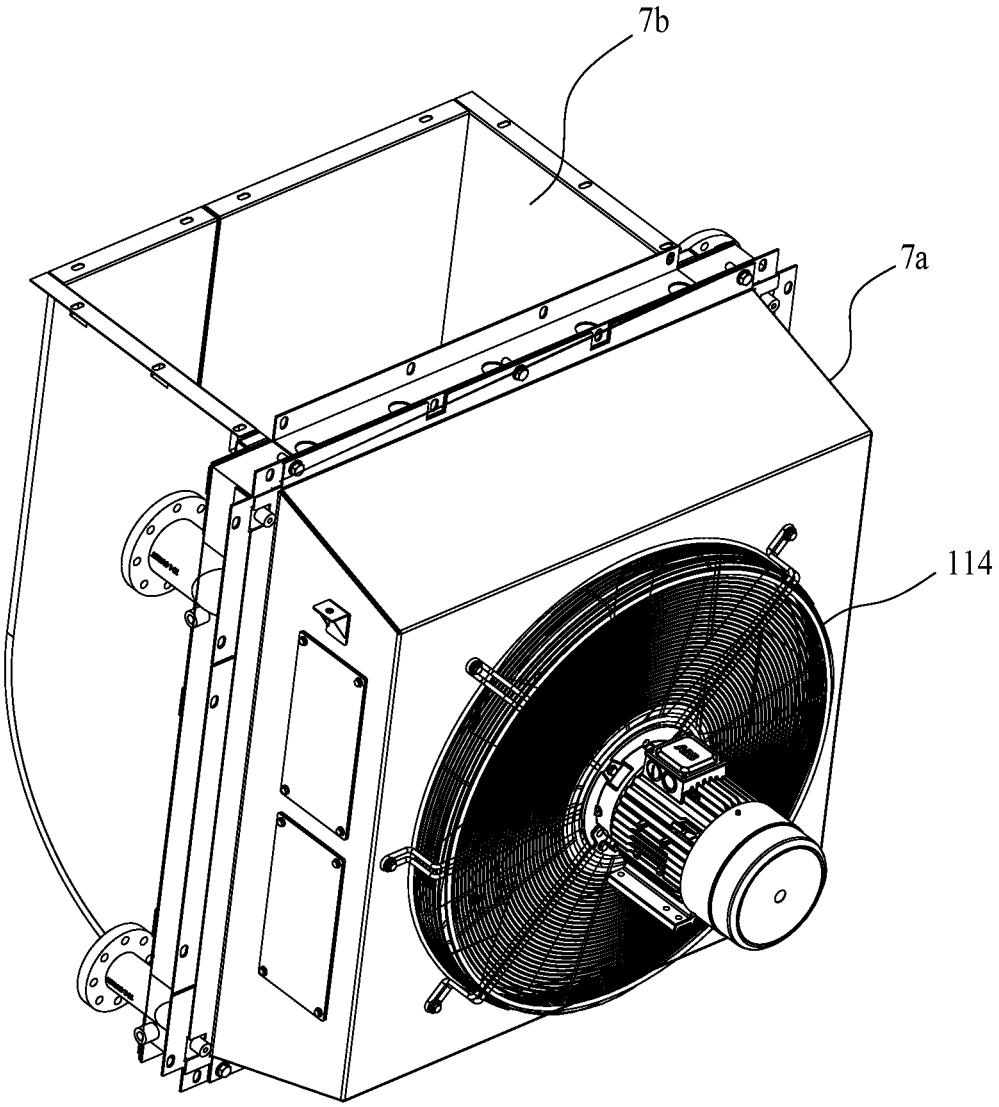
FIG. 5 is an isometric view of a combi-cooler assembly of FIG. 1.

FIG. 5 is an isometric view of a combi-cooler assembly 7 of FIG. 1.

Figure 6:
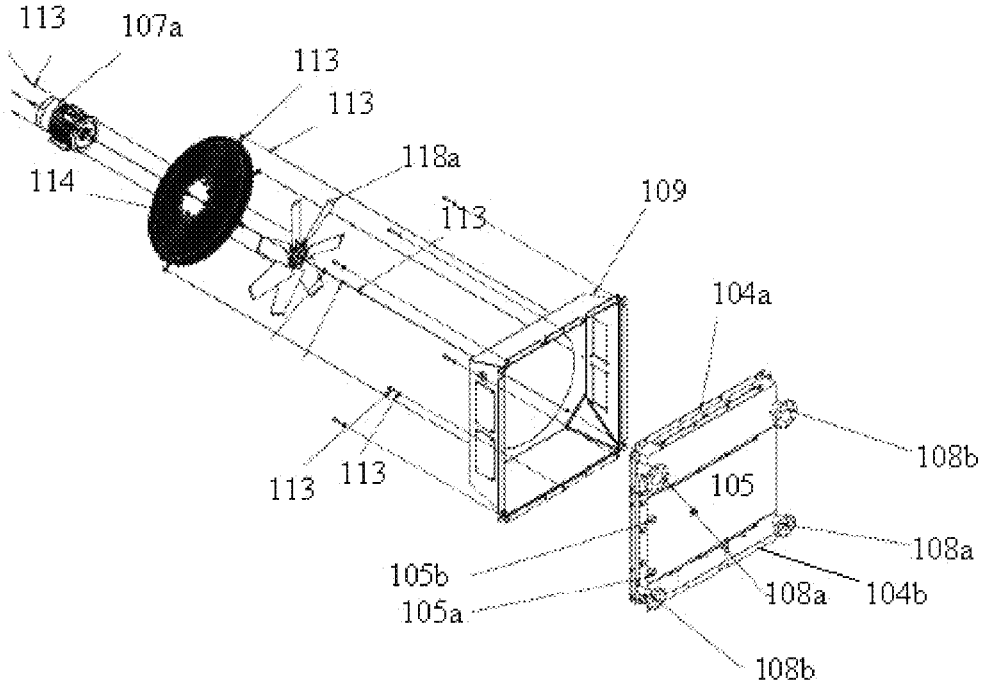
FIG. 6 is an exploded view of a combi-cooler assembly of FIG. 5.

FIG. 6 is an exploded view of the combi-cooler assembly 7 of FIG. 5.

Figure 7:
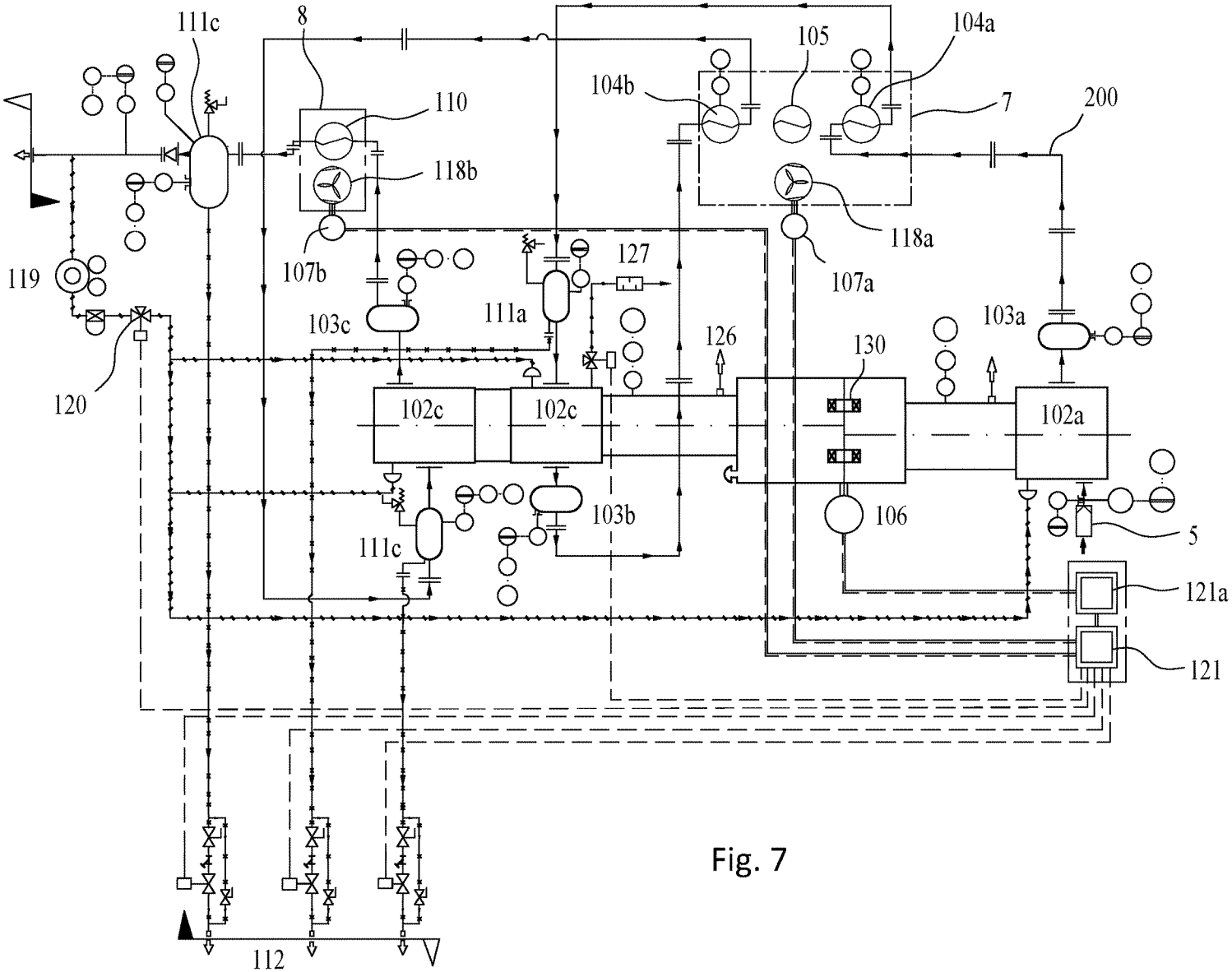
FIG. 7 is a schematic flow diagram of the air in the system.

FIG. 7 is a schematic flow diagram of the air in the system 100.

Figure 8:
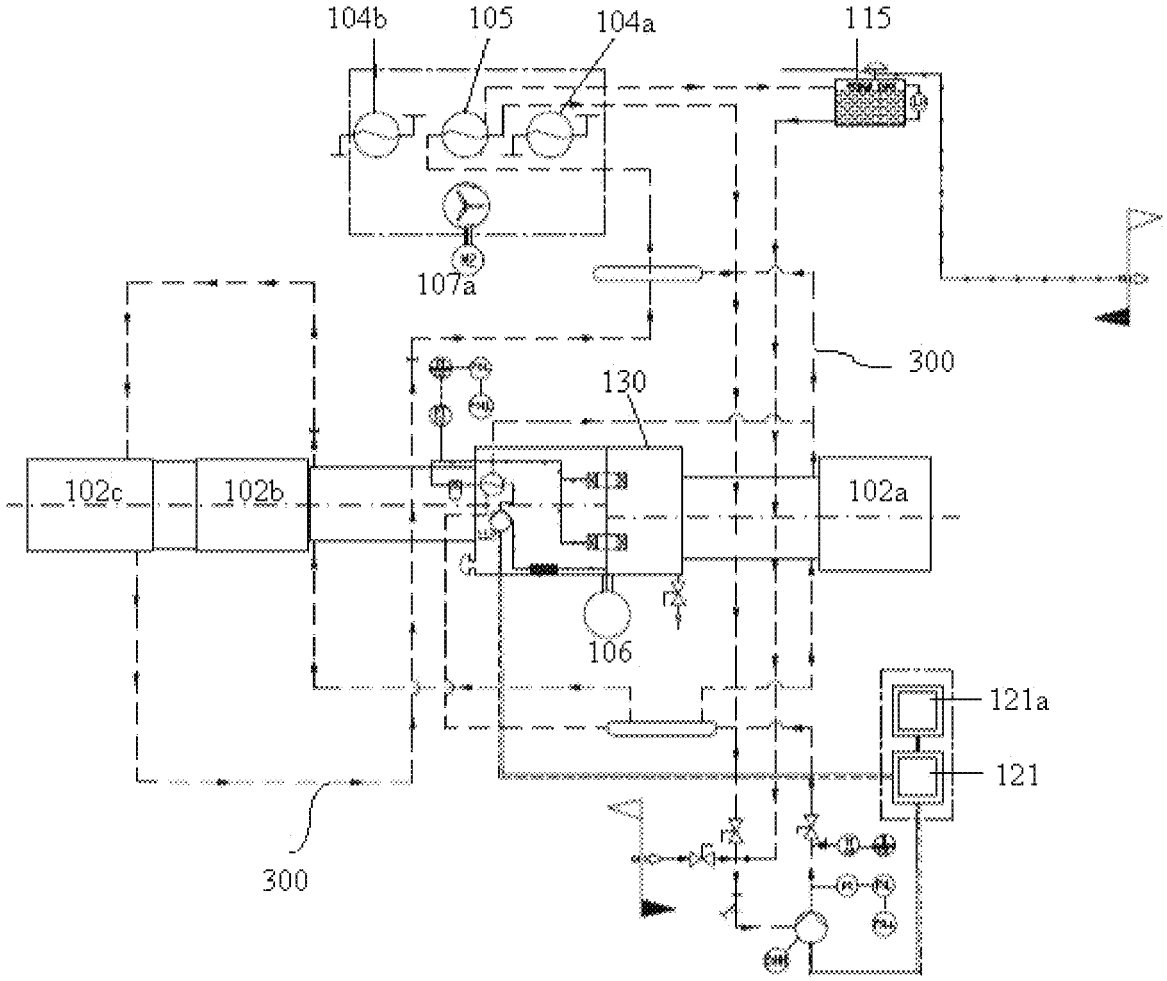
FIG. 8 is a schematic flow diagram of the water in the system.

FIG. 8 is a schematic flow diagram of the water in the system 100.

Other components for air and water handling, including pulsation bottles, safety valves, cylinder suction valves, moisture separators, oil pump, oil filter, non-return valve, drain terminals, pressure regulator, airline filter, pipes, hoses, inlet and outlet manifolds, inlet and outlet headers, and so on, are schematically illustrated in the flow diagrams of FIGS. 7 and 8.

A compressed air generation system 100 of the present disclosure will now be described in detail with reference to FIG. 1 through FIG. 8.

The compressed air generation system 100 comprises a multi-stage reciprocating compressor 1 and a combi-cooler assembly 7. In an embodiment, the multi-stage compressor is a multi-stage reciprocating compressor 1, and includes a first reciprocating compression stage 102*a*, a second reciprocating compression stage 102*b* and a third reciprocating compression stage 102*c*.

The first reciprocating compression stage 102*a* is configured to receive air at ambient pressure conditions. The first reciprocating compression stage 102*a* is configured to compress air to a first predetermined pressure value. The second reciprocating compression stage 102*b* is configured to be in fluid communication with the first reciprocating compression stage 102*a*. The second reciprocating compression stage 102*b* is configured to receive compressed air from the first reciprocating compression stage 102*a*, and is further configured to further compress air to a second predetermined pressure value. The third reciprocating compression stage 102*c* is configured to be in fluid communication with the second reciprocating compression stage 102*b*. The third reciprocating compression stage 102*c* is configured to receive compressed air from the second reciprocating compression stage 102*b*, and is further configured to further compress air to a third predetermined pressure value.

Compression of air by the reciprocating compression stages 102*a*, 102*b*, 102*c* increases the temperature of the air. The resultant product of the compression thus is hot compressed air.

In one embodiment, wherein the first predetermined pressure value ranges from 2.5 to 4 bar. In another embodiment, the second predetermined pressure value ranges from 12 to 16 bar. In yet another embodiment, the third predetermined pressure value ranges from 25 to 42 bar.

The combi-cooler assembly 7 has at least two intercoolers 104*a*, 104*b*. The intercoolers 104*a*, 104*b* are configured to fluidly communicate with the reciprocating compression stages 102*a*, 102*b* to receive hot compressed air from the first reciprocating compression stage 102*a* and the second reciprocating compression stage 102*b*. The intercoolers 104*a*, 104*b* are configured to dissipate heat of the compressed air by passing the hot compressed air therethrough to generate relatively cooler compressed air.

In a preferred embodiment, of the present disclosure, the compressed air generation system 100 is configured as a standalone plug-n-play unit. In another embodiment, the multistage reciprocating compressor 1 and the combi-cooler assembly 7 are housed in a single enclosure. In a preferred embodiment, the compressed air generation system 100 is mounted on a primary mounting platform 2 having a secondary mounting platform 3 provided thereon, upon which the multi-stage reciprocating compressor 1 is configured to be mounted. Preferably, a plurality of anti-vibrational mounts 4 is provided on the secondary mounting platform 3. The anti-vibrational mounts 4 are configured to allow mounting of the multi-stage reciprocating compressor 1 thereon, and are further configured to dissipate the vibrations exerted by the multi-stage reciprocating compressor 1.

An air distribution circuit 200, connecting the multistage reciprocating compressor 1 and the combi-cooler assembly 7, is configured to facilitate fluid communication between the multistage reciprocating compressor 1 and the combi-cooler assembly 7. More specifically, the air distribution circuit 200 allows the hot compressed air to flow from the first reciprocating compression stage 102*a* to the first inter-cooler (104*a*) of the combi-cooler assembly 7, then the cooled compressed air from the first inter-cooler (104*a*) of the combi-cooler assembly 7 to the second reciprocating compression stage 102*b*, hot compressed air from the second reciprocating compression stage 102*b* to the second inter-cooler (104*b*) of the combi-cooler assembly 7, and thereafter cooled compressed air from the second inter-cooler (104*b*) of the combi-cooler assembly 7 to the third reciprocating compression stage 102*c*.

In a preferred embodiment, the air distribution circuit 200 is a closed loop circuit, and recirculates the air therewithin during unloading stage. In another embodiment, the air distribution circuit 200 is an open loop circuit which continuously takes in air and discharges compressed air.

In an embodiment, the multistage reciprocating compressor 1 includes a piston passing through each of the first reciprocating compression stage 102*a*, the second reciprocating compression stage 102*b*, and the third reciprocating compression stage 102*c*, the three pistons being mounted on a crankshaft that is driven by a prime mover. The pistons are configured to be linearly displaced in corresponding cylinders in a reciprocating manner to facilitate compression of air in the compression stages 102*a*, 102*b*, 102*c*. In An embodiment, the multistage reciprocating compressor 1 includes a crank case 130 crankshaft that supports the pistons and the cylinders of the three compression stages 102*a*, 102*b*, 102*c*.

In a preferred embodiment, the compressed air generation system 100 includes a radiator circuit 300. The radiator circuit 300 is configured to be in fluid communication with the first reciprocating compression stage 102*a*, the second reciprocating compression stage 102*b*, the third reciprocating compression stage 102*c*, and the crank case 130. The radiator circuit 300 is configured to carry a coolant fluid therein to facilitate dissipation of heat from the first reciprocating compression stage 102*a*, the second reciprocating compression stage 102*b*, the third reciprocating compression stage 102*c* and the crank case 130.

In an embodiment, the crank case 130 contains oil which not only aids in lubrication of the crankshaft but also helps in cooling of the crankshaft with the help of the radiator circuit 300 passing through the case.

In an embodiment, the radiator circuit 300 is a closed loop circuit.

In one embodiment, each of the intercoolers 104*a*, 104*b* and radiator 105 includes a plurality of channels that are configured to allow the hot compressed air and coolant fluid therethrough. The channels carrying the coolant fluid and the hot compressed air are positioned alternately, to facilitate heat exchange therebetween.

More specifically, the channels carrying the coolant fluid is disposed between channels carrying the hot compressed air inside the combi-cooler (7) assembly.

Each of the intercoolers 104*a*, 104*b* includes an inlet of intercooler 108*a* provided thereon to allow hot compressed air to flow in, and an outlet of intercooler 108*b* configured thereon allow cool compressed air to flow out.

In an embodiment, the combi-cooler assembly 7 includes a radiator 105 configured to be fluid communication with the radiator circuit 300 to receive the hot coolant fluid from a casing channels of the first reciprocating compression stage 102*a*, the second reciprocating compression stage 102*b*, the third reciprocating compression stage 102*c* and the crank case 130. The radiator 105 is configured to facilitate heat dissipation of the coolant fluid of the radiator circuit 300. In an embodiment, the radiator 105 includes a plurality of channels mounted along the walls thereof. The channels are configured to allow the coolant fluid to pass therethrough. In another embodiment, an inlet of radiator 105*a* and an outlet of radiator 105*b* are provided on the radiator 105 to allow the coolant fluid to flow through the radiator 105.

The radiator 105 includes a pump 10 for facilitating circulation of the coolant therethrough. In an embodiment, the radiator 105 is fluidly connected to a surge tank 115 storing the coolant therein, and the pump 10 allows the flow of the coolant to the radiator 105. The coolant fluid inside the radiator 105 circuit may be water, glycol mixed with water or any other composition with water.

In one embodiment, the compressed air generation system 100 includes a compressor suction filter 5 provided at the inlet of each of the first compression stage 102*a* to provide filtered air thereto. The compressor suction filter 5 filters out all the unwanted particles from the air to prevent clogging of the various components of the compressed air generation system 100.

In an embodiment, a buffer vessels 103*a*, 103*b*, 103*c*, are provided at the outlet of each of the first reciprocating compression stage 102*a*, the second reciprocating compression stage 102*b* and the third reciprocating compression stage 102*c*. The buffer vessels 103*a*, 103*b*, 103*c*, are configured to provide buffer gas to compensate the flow from the first reciprocating compression stage 102*a*, the second reciprocating compression stage 102*b* and the third reciprocating compression stage 103*c*, thereby regulating the output flow of the compressed air.

In an embodiment, the combi-cooler assembly 7 is located at a lateral end of the enclosure.

In one embodiment, the compressed air generation system 100 includes an after-cooler assembly 8 provided downstream of the final stage of compression of the third reciprocating compression stage 102*c*. The after-cooler assembly 8 comprises an after-cooler heat exchanger 110 and an after-cooler fan 118*b* configured to reduce the temperature of the hot compressed air let out from the third reciprocating compression stage 102*c*.

In an embodiment, a condensate recovery units 111*a*, 111*b*, 111*c* are provided downstream of the first inter-cooler (104*a*), the second inter-cooler (104*b*) and after-cooler assembly 8. The condensate recovery units 111*a*,111*b*,111*c* are configured to remove condensate matter formed as a result of cooling the hot compressed air in the inter-cooler 7 and after-cooler assembly 8. The condensate recovery units 111*a*, 111*b*, 111*c* are also helps in minimizing the pulsations during the compression in each stage of the compressed air.

In an embodiment, a pressure regulator 119 is provided downstream of the condensate recovery unit 111*c* to regulate the pressure of the compressed air during unloading stage and reduce to ambient conditions before passing it back to the first reciprocating compression stage 102*a*, thereby completing the closed loop.

Preferably, a solenoid valve 120 is provided downstream of the pressure regulator 119 to allow or stop the flow of the air from the pressure regulator 119 to the first reciprocating compression stage 102*a* during unload conditions.

In an embodiment, the compressed air generation system 100 includes a first drive motor 106 connected to the crankcase. The first drive motor 106 is configured to drive the crankshaft.

In an embodiment, the compressed air generation system 100 includes a blower fan 118*a* provided in the combi-cooler assembly 7. The blower fan 118*a* is configured to dissipate heat from the hot compressed air and the hot coolant fluid passing through the intercoolers 104*a*, 104*b* and the radiator 105. A second drive motor 107*a* is provided to drive the blower fan 118*a*. The second drive motor 107*a* is arranged inside the combi-cooler assembly 7. In an embodiment, the compressed air generation system 100 includes a third drive motor 107*b* connected to the after-cooler assembly 8. The third drive motor 107*b* is configured to drive the after-cooler fan 118*b*. The after-cooler fan configured to dissipate heat from the hot compressed air passing through after-cooler heat exchanger 110 from the third reciprocating compression stage 102*c*. Both the combi-cooler assembly 7 and after-cooler heat exchanger 110 are air cooled by blowing atmospheric air over the combi-cooler assembly 7 and after-cooler heat exchanger 110 with the help of the blower fan 118*a* and after-cooler fan 118*b*.

In a preferred embodiment, the compressed air generation system 100 includes an electronic control panel 121, 121*a* configured to control the operation of the compressed air generation system 100, by controlling the power supplied to the various drive motors, controlling the solenoid valves at various locations to maintain the flow uniform throughout the circuit.

In an operative configuration, explained with reference to FIG. 7, air at ambient conditions is supplied to the first reciprocating compression stage 102*a* after passing the air through the compressor suction filter 5. The crankshaft displaces the piston to facilitate compression of air in the first reciprocating compression stage 102*a*. Hot compressed air at a first predetermined value is discharged from the first compression stage 102*a*. The buffer vessels 103*a*, 103*b*, 103*c* compensate the flow of the discharged compressed air from each reciprocating compression stage to the subsequent stage of compressor. Since, the temperature of the compressed air is very high, it is passed to the combi-cooler assembly 7, wherein the compressed air is lead through the first intercooler 104*a* to help dissipation of the heat from the hot compressed air. The cooled compressed air is then passed to the condensate recovery unit 111*a*, helps in removing the condensate matter from the air before it enter into the second reciprocating compression stage 102*b*, where it is again compressed to a second predetermined value. The compressed air from the second reciprocating compression stage 102*b* is passed then to the combi-cooler assembly 7, wherein it is passed through the second intercooler 104*b* to help in dissipation of heat. The cooled compressed air is thereafter passed to the condensate recovery unit 111*b*, helps in removing the condensate matter from the air before it enter into the third reciprocating compression stage 102*c*, wherein it is further compressed to a third predetermined value.

The resultant compressed air is then passed through the after-cooler assembly 8 where it is cooled to a desired temperature value. Thereafter, the cooled compressed air is passed through a condensate recovery unit 111*c* to allow removal of condensate matter from the air, and then discharged for a particular application. If there is no requirement of compressed air discharge, i.e., at a no-load condition, the pressure of the compressed air is reduced to ambient conditions and again passed to the first reciprocating compression stage 102*a* through the pressure regulator 119 and the solenoid valve 120.

In another operative configuration, as depicted by FIG. 8, the coolant fluid flows from through the radiator circuit 300 to cool the components of the compressed air generation system 100 namely, the crank case 130, the first reciprocating compression stage 102*a*, the second reciprocating compression stage 102*b*, and the third reciprocating compression stage 102*c* of the multi-stage reciprocating compressor 1. In an embodiment, the coolant fluid flows into the crank case 130 where it exchanges heat with the oil contained in the crank case 130, thereby cooling the oil. Similarly, the coolant fluid passes through the multi-stage reciprocating compressor 1 to dissipate heat therefrom.

The coolant fluid is thereafter made to pass through the radiator circuit 300, and passed into the inlet of radiator 105*a*. The heat of the coolant fluid while flowing through the radiator 105 is dissipated by the air blown by the blower fan 118*a* over the radiator 105. The coolant fluid condenses. The condensed coolant fluid flows out through the radiator exit and passed to the surge tank 115, from where it is passed back to the crank case 130, the first reciprocating compression stage 102*a*, the second reciprocating compression stage 102*b*, and the third reciprocating compression stage 102*c* of the multi-stage reciprocating compressor 1.

In an embodiment, vents 126 are provided at predetermined locations on the pistons. The vents 126 allow passage of any air content that may be leaked from the compressor during compression.

The foregoing description of the embodiments has been provided for purposes of illustration and not intended to limit the scope of the present disclosure. Individual components of a particular embodiment are generally not limited to that particular embodiment but are interchangeable. Such variations are not to be regarded as a departure from the present disclosure, and all such modifications are considered to be within the scope of the present disclosure.

The present disclosure described hereinabove has several technical advantages including, but not limited to, the realization of a compressed air generation system 100 having multi-stage compression:

which is a standalone, plug-and-play unit;

from which the high magnitude of heat generated is removed in an efficient manner;

that generates noise within the stipulated limits; and that provides ease of installation by minimizing the requirement for cooling ducts.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

Any discussion of materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A compressed air generation system comprising:

a multistage reciprocating compressor including:

a first reciprocating compression stage configured to receive air at ambient pressure conditions, said first reciprocating compression stage configured to compress air to a first predetermined pressure value, a second reciprocating compression stage in fluid communication with said first reciprocating compression stage, said second reciprocating compression stage configured to receive compressed air from said first reciprocating compression stage, and wherein said second reciprocating compression stage configured to compress received compressed air from said first reciprocating compression stage to a second predetermined pressure value, and a third reciprocating compression stage in fluid communication with said second reciprocating compression stage, said third reciprocating compression stage configured to receive compressed air from said second reciprocating compression stage, and wherein said third reciprocating compression stage configured to compress received compressed air from said second reciprocating compression stage to a third predetermined pressure value;

a combi-cooler assembly having at least two intercoolers and a radiator, said least two intercoolers fluidly communicating with said reciprocating compression stages to receive hot compressed air from said first reciprocating compression stage and said second reciprocating compression stage, said least two intercoolers configured to dissipate heat of the compressed air by passing the hot compressed air therethrough to generate relatively cooler compressed air for a next subsequent stage, wherein said multi-stage reciprocating compressor and said combi-cooler assembly, including said at least two intercoolers, are housed in a single enclosure;

an after-cooler assembly configured to be in communication with the third reciprocating compression stage, wherein the after-cooler assembly is configured to reduce the temperature of the hot compressed air coming out from the third reciprocating compression stage; and a radiator circuit including said radiator configured to be in fluid communication with said first reciprocating compression stage said second reciprocating compression stage, said third reciprocating compression stage, and a crankcase included in said multistage reciprocating compressor, wherein said radiator is configured to be in fluid communication with said radiator circuit to receive hot coolant fluid from said radiator circuit, wherein said radiator circuit is configured to carry a coolant fluid therein to facilitate dissipation of heat from said first reciprocating compression stage, said second reciprocating compression stage, said third reciprocating compression stage, and said crankcase; wherein said combi-cooler assembly further comprises a casing and a fan, and wherein said at least two intercoolers, said radiator, and said fan are housed in said casing to form a compact, integral combi-cooler assembly unit, said fan being configured to blow atmospheric air from an air intake over the at least two intercoolers and the radiator, and thereby dissipate heat from the hot compressed air passing through the at least two intercoolers and the hot coolant fluid passing through the radiator.

2. The compressed air generation system as claimed in claim 1, wherein said after-cooler assembly is also housed in the single enclosure.

3. The compressed air generation system as claimed in claim 1, wherein said compressed air generation system includes an air distribution circuit configured to facilitate fluid communication between said multistage reciprocating compressor and said combi-cooler assembly.

4. The compressed air generation system as claimed in claim 3, wherein said air distribution circuit is a closed loop circuit.

5. The compressed air generation system as claimed in claim 1, wherein said radiator circuit is a closed loop circuit.

6. The compressed air generation system as claimed in claim 1, wherein said radiator includes a plurality of channels mounted along walls thereof, said channels configured to allow said coolant fluid to pass therethrough.

7. The compressed air generation system as claimed in claim 1, wherein said radiator circuit includes a pump for facilitating circulation of said coolant fluid therethrough.

8. The compressed air generation system as claimed in claim 1, wherein the coolant fluid is water or a composition with water.

9. The compressed air generation system as claimed in claim 1, which includes a buffer vessel provided at an outlet of each of said first reciprocating compression stage, said second reciprocating compression stage, and said third reciprocating compression stage, said buffer vessels configured to provide flow compensation from said first reciprocating compression stage, said second reciprocating compression stage, and said third reciprocating compression stage.

10. The compressed air generation system as claimed in claim 2, wherein said combi-cooler assembly is located at a lateral end of said single enclosure.

11. The compressed air generation system as claimed in claim 1, wherein condensate recovery units are provided downstream of said least two intercoolers and said after-cooler assembly, said condensate recovery units configured to remove condensate matter formed as a result of cooling the hot compressed air in said least two intercoolers and said after-cooler assembly.

12. The compressed air generation system as claimed in claim 1, which includes a surge tank configured to store the coolant fluid therein.

13. The compressed air generation system as claimed in claim 1, wherein the coolant fluid is glycol mixed with water.

* * * * *